US005782690A

United States Patent [19]

Gustafson et al.

[11] Patent Number: 5,782,690

[45] Date of Patent: Jul. 21, 1998

[54] CURTAIN FIRE DAMPER

[75] Inventors: Bradley Kent Gustafson, Burlington; Robert Arthur Horr, Fairfax; David James Miller; Frederick Charles Ringer, Jr., both of Essex Junction; Conrad Wexelblatt, South Burlington, all of Vt.

[73] Assignee: International Business Machines Corporation, Armonk, N.Y.

[21] Appl. No.: 872,127

[22] Filed: Jun. 6, 1997

[51] Int. Cl.[6] ..... F05F 15/20

[52] U.S. Cl. ..... 454/369; 160/1; 160/6; 454/170

[58] Field of Search ..... 454/169, 170, 454/257, 357, 369; 160/1, 6, 127, 133

[56] References Cited

U.S. PATENT DOCUMENTS

| | | | |
|---|---|---|---|
| 1,419,357 | 6/1922 | Carter | 454/169 X |
| 1,575,626 | 3/1926 | Haapanen | 454/169 |
| 2,621,725 | 12/1952 | Schacikoski | 454/170 |
| 4,194,521 | 3/1980 | Banta . | |
| 4,333,392 | 6/1982 | Nailor et al. . | |
| 4,579,047 | 4/1986 | Zielinski . | |
| 5,551,499 | 9/1996 | McRoberts . | |
| 5,577,541 | 11/1996 | McKeon . | |
| 5,642,767 | 7/1997 | Nair | 160/8 |

FOREIGN PATENT DOCUMENTS

| | | |
|---|---|---|
| 2478726 | 3/1980 | France . |
| 26 19 779 | 11/1977 | Germany . |
| 138344 | 10/1979 | Germany . |
| 3444163 | 6/1986 | Germany . |
| 3444163 | 2/1990 | Germany . |

*Primary Examiner*—Harold Joyce
*Attorney, Agent, or Firm*—Schmeiser, Olsen & Watts; James M. Leas

[57] ABSTRACT

A damper door system that includes an opening in a planar wall, a retractable damper door and a track extending through said opening. The damper door includes slots that are conformable to the track when the door is in a closed position. In addition, the slots in the damper door include an intumescent material for sealing the door shut in the event of a fire.

20 Claims, 4 Drawing Sheets

CURTAIN FIRE DAMPER

BACKGROUND OF THE INVENTION

1. Technical Field

The present invention relates generally to a fire damper system, and more specifically to a fire damper system for use in a passageway between fire walls in a semiconductor manufacturing operation.

2. Relevant Art

Present semiconductor wafer manufacturing operations and the like require numerous separate fabrication processes, each requiring unique facilities, tools and environmental controls. In order to achieve this, a manufacturing plant must include numerous rooms customized to meet the needs of the specific process being performed. To facilitate this process, an automated means for transporting highly sensitive material (e.g., silicon) from location to location is also required. During a typical semiconductor fabrication operation, it is not unusual to require movement of the same silicon materials to and from as many as fifty different rooms. Because the fabrication process requires strict adherence to various clean room techniques, numerous logistical problems must be overcome when moving the semiconductor materials.

A particular problem arises when materials must be transported between rooms separated by a firewall or the like. Most large plant facilities include fire walls built within the plant to minimize the damage caused by a fire by keeping the fire localized to a certain area. In order to achieve this, openings between firewalls must be eliminated or include some type of door that can be shut when a fire is detected. Thus, some type of "close-able" passageway is required for transporting silicon material between rooms separated by a firewall.

One automated method of transporting semiconductor products within a fabrication plant is to use a track system that includes cars that ride on the track and hold sensitive materials. Such systems, such as those sold by PRI™, provide an automated mechanism for transporting and handling highly sensitive materials. However, as noted, a problem is created when the track must pass between rooms that are separated by a firewall. Because a firewall cannot include permanent openings, a unique solution is required.

Typically, the problem is addressed by the use of some sort of "swing down" fire door that is activated when a fire is detected in the building. Present fire door designs that "swing down" are problematic due to large amount of room required and necessary ceiling height. Moreover, the slamming of a swing down door, as the door is closed, may cause an undesired impact resulting in damage to expensive materials and equipment. This is of considerable concern particularly in the case where false alarms or planned fire drills occur. Thus, an improved fire door design is required.

SUMMARY OF THE INVENTION

The present invention provides a damper system wherein the system comprises an opening in a planar surface such as a fire wall, a track extending through the opening, wherein the track has a defined shape and wherein the track facilitates the movement of an object through an opening, and a movable damper in the opening to provide closure of the open space if necessary, wherein the movable damper includes a slot cut out of the damper that is "sealably" conformable about the track when the damper is closed.

In order to further facilitate the complete closure of the opening, the slot may be lined with an intumescent material that will further seal the space between the door and the track in the event of a fire. The intumescent material may also be placed along the sill of the opening to further seal the bottom of the door to the bottom edge of the opening.

It is therefore an advantage of the present invention to provide a low cost solution to providing "close-able" openings in fire walls between rooms in a fabrication processing plant.

It is a further advantage of the present invention to provide a fire door that is conformable about a track.

It is therefore a further advantage of the present invention to provide a retractable fire door system that requires a minimal amount of space.

It is therefore a further advantage of the present invention to provide a fire damper system that incorporates an intumescent material for sealing the openings between two rooms during a fire.

Other advantages and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

BEST MODE FOR CARRYING OUT THE INVENTION

Figure 1:
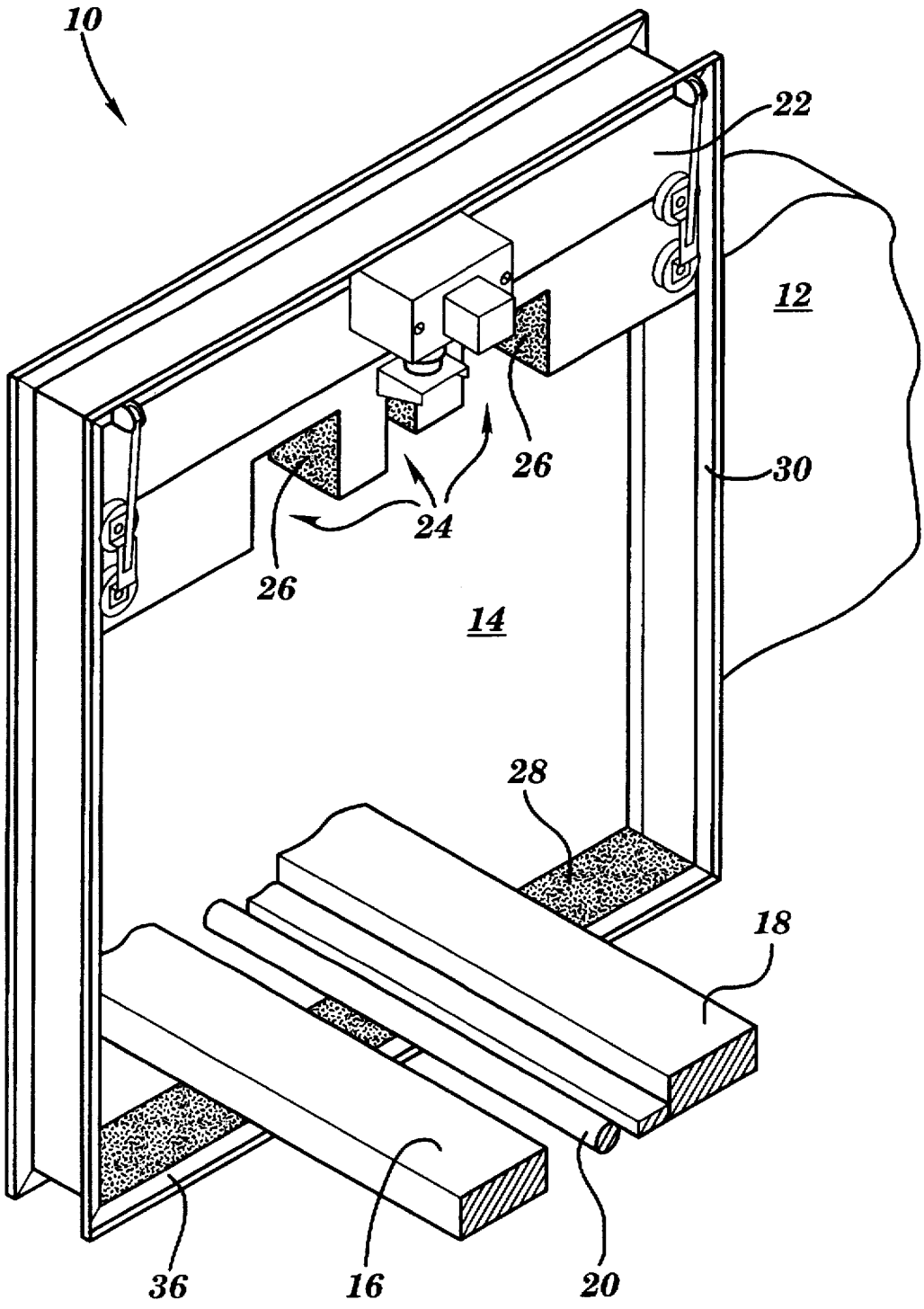
FIG. 1 depicts an isometric view of a damper door system in accordance with a preferred embodiment of the present invention.

FIG. 1 depicts an isometric view of a damper door system 10 for insertion into a planar wall 12 (e.g., a fire wall, shown in part) that separates a first room from a second room. The door system 10 includes a frame structure 30 and a damper door 22. Also shown is an opening 14 within the door system 10 Extending through the opening 14 is a track assembly 16, 18 and 20 for holding and transporting a car (not shown) from one side of planar wall 12 to the other side. Damper door 22 (shown in the open position) is movable up and down within the planar wall 12. Damper door 22 includes slots 24 that are conformable to the various track parts 16, 18, and 20 when the door 22 is in the closed position. Thus, when a fire or the like is detected, the door can be closed to effectively seal off the two rooms separated by the wall 12. To provide further protection, an intumescent material 26, 28 may be placed within each slot 24 and along a bottom edge, or sill 36.

Intumescent material 26, 28 is adapted to seal damper door 22 to the track assembly 16, 18 and 20 and to the sill 36 in the event of a fire. It may also be utilized elsewhere within the damper system as necessary. Any known intumescent material capable of expanding and sealing an opening (e.g., a crack) when exposed to intense heat may be utilized.

Figure 2:
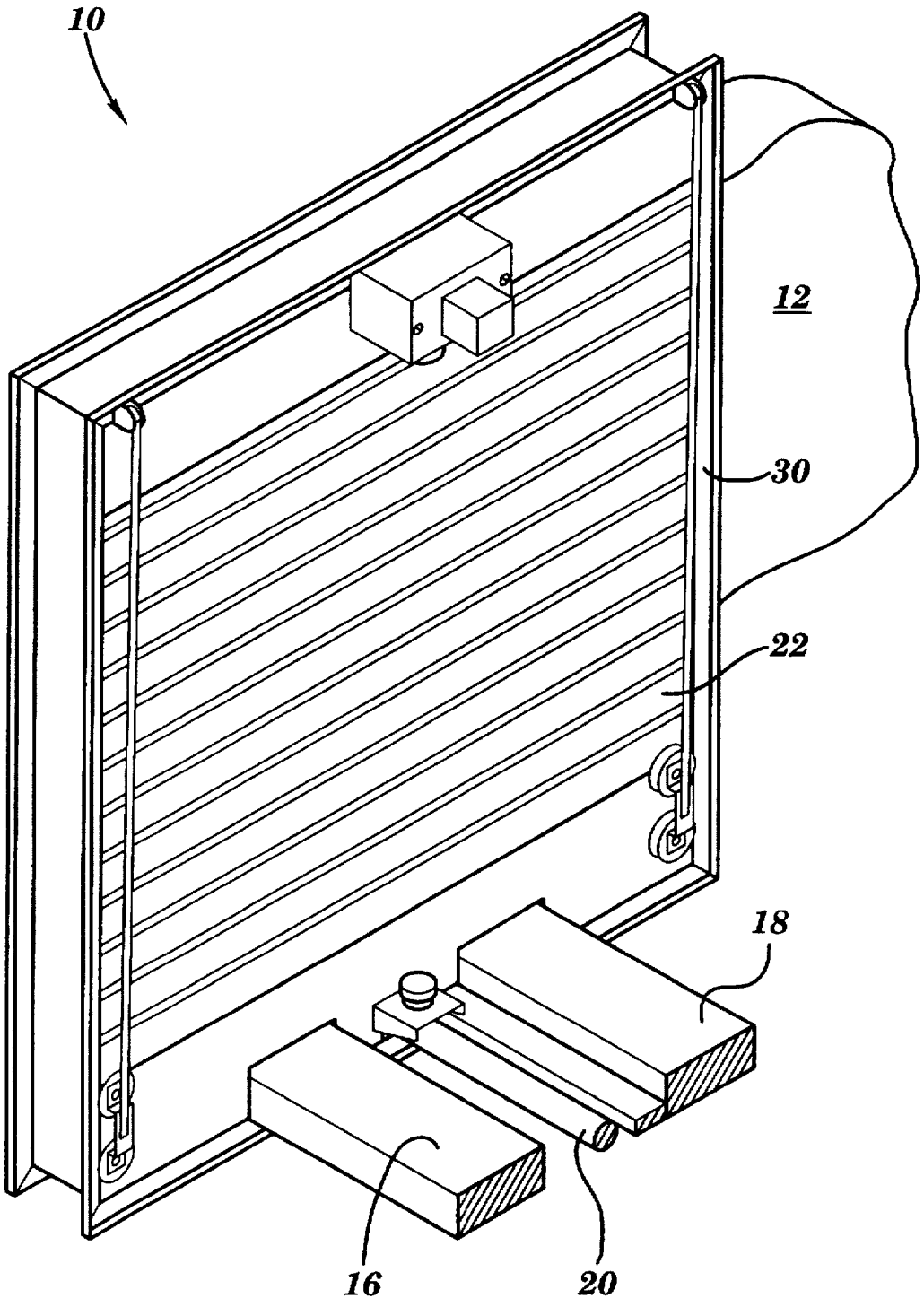
FIG. 2 depicts an isometric view of a damper door system with a damper door in a closed position in accordance with a preferred embodiment of the present invention.

FIG. 2 shows the damper door system 10 of FIG. 1 with damper door 22 in the closed position. It can be seen that door 22 is conformable about track assembly 16, 18 and 20, thereby completely sealing off the passageway.

Figure 3:
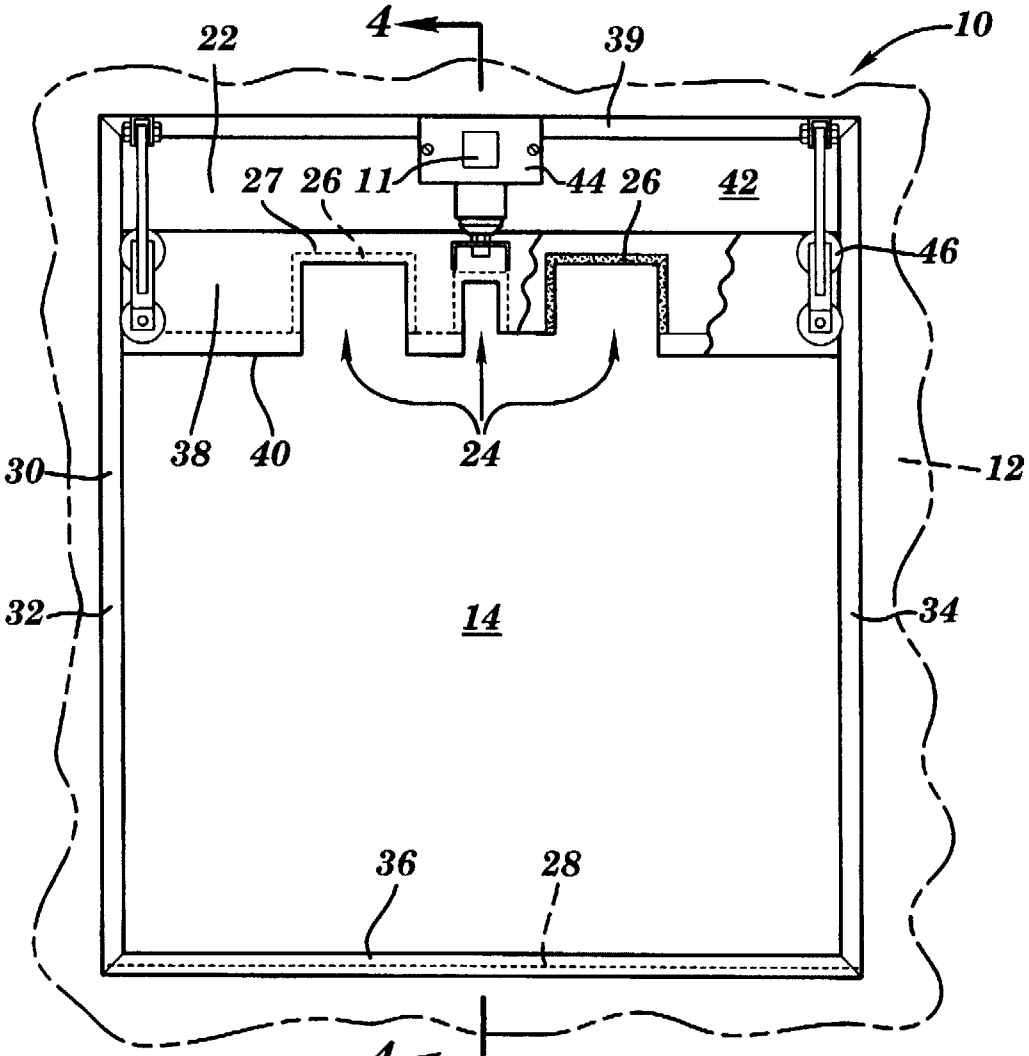
FIG. 3 depicts a front view of a damper door system in accordance with a preferred embodiment of the present invention.

FIG. 3 depicts a front view of the damper door system 10 with the door 22 in the open position. The damper door 22 includes a slidable rail portion 38 and a plurality of retractable door panels 42 (see FIG. 4 for more detail). The damper door 22 is slidably mounted between opposing side rails 32 and 34. Slidable rail 38 includes a sealing edge 40 that mates with a bottom edge 36 of the damper door frame 30 when the door is closed. As noted above, the slidable rail 38 portion of damper door 22 includes slots 24 that extend from a front side of the rail 38 through the back side (not shown) of the rail. Within each slot 24, cavities 27 may be cut into the door to hold intumescent material 26.

Also shown in FIG. 3 is an electromagnetic release 44 that is triggered by an environmental sensor 11 or the like. Although shown in close proximity to the damper door 22, the environmental sensor 11 (or a plurality of sensors) may be located away from the damper door system 10. (An alternate solution would be to use a fusible link. However, this would require heat in the immediate proximity to melt the link.) Thus, when a fire or the like is detected by a sensor and the electromagnetic release 44 releases door 22 (or a fusible link melts), gravity, or some other driving force (e.g., springs, weights, etc.) causes door 22 to lower to a closed position.

Left and right opposing rails 32 and 34 are separated by a top and a bottom edge (i.e., an upper and lower rail) 39 and 36, thereby forming a frame structure 30 for holding the damper door 22. In order to facilitate upward and downward movement of the door 22 within the planar opening, wheel assemblies 46 or the like may are utilized to roll up and down side rails 32 and 34.

Figure 4:
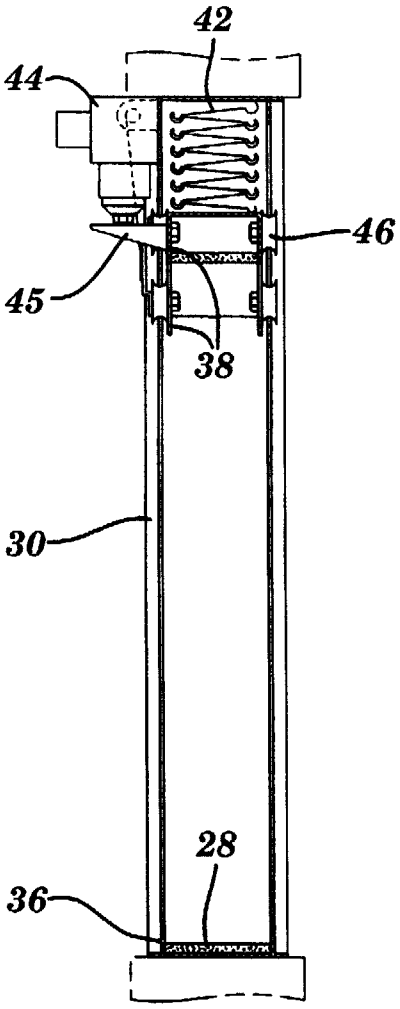
FIG. 4 depicts a cross sectional side view of a damper door in accordance with a preferred embodiment of the present invention.

FIG. 4 depicts a cross sectional side view of the damper door system 10 cut along line 4—4 of FIG. 3 with the damper door 22 is in the up position. Damper door 22 includes slidable rail 38 having wheel assemblies 40 connected thereto, and a plurality of hingedly connected retractable panels 42 connected between the top of rail 38 and the bottom of upper rail 39 of frame structure 30. Also shown is electromagnetic release 44 which holds the damper door 22 in the up position. Damper door 22 may include a receiving assembly or plate 45 to which electromagnetic release 44 can attach. Finally, intumescent material 28 is shown on the bottom edge, or sill 36 of the within frame structure 30 in the fire wall.

Figure 6:
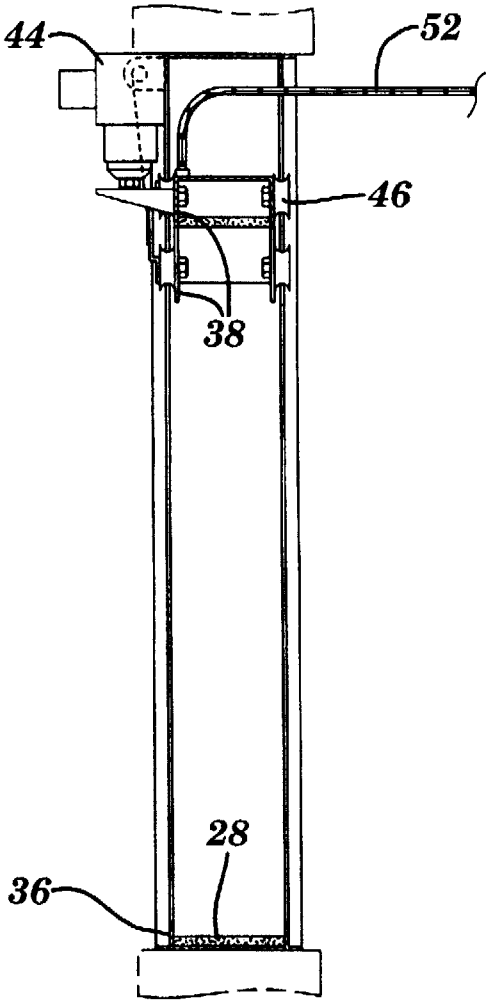
FIG. 6 depicts a cross sectional side view of a second alternative embodiment of the present invention.
Figure 5:
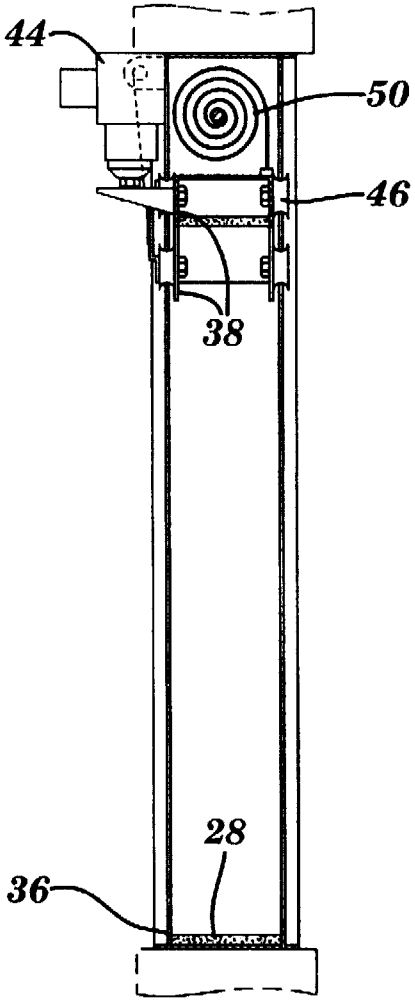
FIG. 5 depicts a cross sectional view of an alternate embodiment of the present invention.

FIGS. 5 and 6 depict cross sectional side views of alternate embodiments of the present invention. The damper door systems of these embodiments are similar to the embodiment shown in FIGS. 1–4 with the exception of the retractable portion of the door 22. For example, similar to the preferred embodiment, the alternative damper door systems may include a slidable rail 38 that include slotted cut-outs containing intumescent material, wheel assemblies 46, an electromagnetic release 44, etc. Pursuant to the embodiment of FIG. 5, the damper door comprises a retractable roll-up door 50 rather than a hingedly connected retractable door. Alternatively, the embodiment of FIG. 6 comprises a garage door style retractable door 52 that runs coplanar with the ceiling (not shown) when the door is in the up position. It is recognized that other retractable systems may also be may also be utilized within the scope of this invention.

While the invention has been particularly shown and described with reference to preferred exemplary embodiments thereof, it will be understood by those skilled in the art, that the foregoing and other changes in form and details may be made therein without departing from the spirit and scope of the invention. For example, it is possible that the door system may include a door that opens downwardly or horizontally rather than upwardly. It is also possible for the invention to reside in a floor or ceiling rather than a wall.

We claim:

1. A damper system, said system comprising:

an opening in a planar surface;

a track extending through said opening, wherein said track has a defined shape and wherein said track facilitates the movement of an object through said opening; and a movable damper in said opening to provide closure of said opening, wherein said damper is sealably conformable to said track when said damper is closed.

2. The movable damper of claim 1 comprising a slot penetrating through said movable damper, said slot being sealably conformable about said track.

3. The damper system of claim 2 wherein said slot is lined with an intumescent material.

4. The damper system of claim 1 wherein said opening includes a sill wherein said sill is lined with an intumescent material.

5. The damper system of claim 1 wherein said damper moves exclusively along said planar surface.

6. The damper system of claim 1 wherein said damper is rolled up for storage.

7. The damper system of claim 1 wherein said damper moves perpendicularly along said planar surface for storage.

8. The damper system of claim 1 wherein said damper is actuated by an electromagnetic release triggered by an environmental sensor.

9. A damper door for sealing an open passageway in a planar wall, said damper door comprising:

a frame having a pair of opposing guides for guiding said damper door, said pair of opposing guides being separated by a first and a second edge;

a slidable rail mounted between said pair of opposing guides, said rail having a front side, a back side, and a sealing edge;

a slotted opening in said slidable rail, wherein said slotted opening is cut along said sealing edge and extends through said front and back sides, and wherein said slotted opening is sealably conformable to a fixed object penetrating through said frame and mounted along said first edge of said frame; and a plurality of hingedly connected retractable panels, said panels mounted between said second edge of said frame and said slidable rail.

10. The damper door of claim 9 wherein said slotted opening is lined with an intumescent material.

11. The damper door of claim 9 wherein said first edge of said frame is lined with an intumescent material.

12. The damper door of claim 9 wherein said damper door is actuated by an electromagnetic release triggered by an environmental sensor.

13. The damper door of claim 9 wherein said slidable rail includes wheels for facilitating movement of the damper door.

14. The damper door of claim 9 wherein said sealing edge of said slidable rail includes cavities along said slotted opening.

15. The damper door of claim 14 wherein said cavities include an intumescent material.

16. A damper system, said damper system comprising:

a planar wall separating a first room from a second room;

an opening in said planar wall, said opening providing passageway between said first and second rooms;

a track extending through said opening for transporting objects between said first and second rooms, said track being fixed to a first edge in said opening;

a retractable damper door mounted in said opening, said damper door being slidably positionable toward and away from said first edge in said opening; and a slotted opening cut along a sealing edge of said damper door, said slotted opening being sealably conformable around said track when said damper door is closed.

17. The damper system of claim 16 wherein said damper door is actuated by an electromagnetic release triggered by an environmental sensor.

18. The damper system of claim 16 wherein said damper door includes cavities proximate said slotted openings.

19. The damper system of claim 18 wherein said cavities contain an intumescent material.

20. The damper system of claim 16 wherein said damper door comprises a plurality of hingedly connected panels.

* * * * *